United States Patent [19]

Piretti

[11] Patent Number: 4,718,354

[45] Date of Patent: Jan. 12, 1988

[54] EXTENSIBLE TABLE

[75] Inventor: Giancarlo Piretti, Bologna, Italy

[73] Assignee: Castilia S.p.A., Bologna, Italy

[21] Appl. No.: 777,812

[22] Filed: Sep. 19, 1985

[30] Foreign Application Priority Data

Sep. 19, 1984 [IT] Italy ..... 67938 A/84

[51] Int. Cl.[4] ..... A47B 1/06

[52] U.S. Cl. ..... 108/68; 108/143

[58] Field of Search ..... 108/68, 67, 65, 63, 108/143, 93, 102; 248/429, 430, 670, 1 J

[56] References Cited

U.S. PATENT DOCUMENTS

| | | | |
|---|---|---|---|
| 457,443 | 8/1891 | Pickett | 108/68 |
| 542,139 | 7/1895 | Brodin | 108/68 |
| 555,727 | 3/1896 | Loomis . | |
| 659,624 | 10/1900 | Myers | 108/67 |
| 711,042 | 10/1902 | Dusenbery | 108/68 |
| 835,790 | 11/1906 | Holm | 108/68 |
| 868,423 | 10/1907 | Fuller | 108/68 |
| 1,246,085 | 11/1917 | Giard | 108/68 |
| 2,848,291 | 8/1958 | Hafekost et al. | 108/68 X |
| 2,937,765 | 5/1960 | Shank | 108/143 |

FOREIGN PATENT DOCUMENTS

| | | | |
|---|---|---|---|
| 65600 | 2/1914 | Fed. Rep. of Germany . | |
| 67561 | 6/1914 | Fed. Rep. of Germany . | |
| 125629 | 7/1949 | Sweden | 108/68 |

*Primary Examiner*—Kenneth J. Dorner
*Assistant Examiner*—José V. Chen
*Attorney, Agent, or Firm*—Sughrue, Mion, Zinn, Macpeak & Seas

[57] ABSTRACT

An extensible table comprises a rigid panel defining the working plane of the table in a condition of minimum extension thereof and at least one structure for extending the panel including a frame connected to the panels so as to be slidable in a direction parallel to the plane of the panel and movable between an extreme retracted position within the panel and an extreme extended position in which the frame projects from one side of the panel. The table further includes a flexible covering sheet fixed to the panel and having a part projecting from the panel and extending in the direction of sliding of the frame, and guides for the flexible sheet carried by the frame and engaged by the flexible sheet so that the latter has a first pass arranged to constitute an elongation of the working plane and a second pass guided beneath the first pass; the lengths of the first and second passes being a minimum and a maximum respectively in the completely retracted position of the frame and a maximum and a minimum respectively in the completely extended position of the frame.

14 Claims, 18 Drawing Figures

1
2
4
5
7
16
17
18
21
37
V
V

EXTENSIBLE TABLE

The present invention relates to extensible tables.

The object of the present invention is to provide an extensible table which can assume any configuration intermediate minimum and maximum conditions of extension, while at the same time having a simple, reliable and practical structure.

In order to achieve this object, the invention provides an extensible table, characterised in that it comprises:

a rigid panel, defining the working plane of the table in a condition of minimum extension thereof, at least one structure for extending the panel including a frame connected to the panel so as to be slidable in a direction parallel to the plane of the panel and movable between an extreme position retracted within the panel and an extreme extended position in which the frame projects from one side of the panel, a flexible covering sheet fixed to the panel and having a part projecting from the panel and extending in the direction of sliding of the said frame, guide means for the flexible sheet carried by the said frame and engaged by the flexible sheet so that the latter has a first pass arranged to constitute an elongation of the working plane and a second pass guided beneath the first pass; the lengths of the first and second passes being a minimum and a maximum respectively in the completely retracted position of the frame and a maximum and a minimum respectively in the completely extended position of the frame.

The said frame includes, for example, at least one pair of guide rods slidable in corresponding guide passages formed in the rigid panel and a cross member fixed to the ends of these guide rods furthest from the guide panel. To the lower surface of part of the flexible sheet which projects from the rigid panel there are connected a plurality of stiffening bars extending perpendicular to the direction of sliding of the frame and the frame has two lateral U-section guide channels fixed to the ends of the cross member. The said lateral guide channels each have two parallel horizontal arms slidable in the rigid panel and a curved intermediate part.

The guide channels are engaged by pins projecting from the ends of the stiffening bars.

In a preferred embodiment, structures for lengthening the rigid panel project from two opposite sides of the latter and a respective pair of table legs is connected to the frame of each lengthening structure. In this embodiment a single flexible cover sheet is provided having a central part covering the rigid panel and two end parts associated with the two lengthening structures.

According to a further characteristic, each table leg is connected to an elongate horizontal element at its upper end which is slidable on one side of the rigid panel, the element having a guide member engaged in the corresponding guide groove of the rigid panel.

According to a further preferred characteristic, a layer of soft plastics material is applied to the lower surface of the projecting part of the flexible sheet, and the said stiffening bars are partially embedded in this soft plastics. The pins projecting from the ends of the stiffening bars which engage the lateral guide channels are mounted at the ends of a longitudinal hole provided in each stiffening bar.

The rigid panel preferably includes at least one extruded metal profile defining the said guide passages and within which are engaged rolling means with which the guide rods of the frame are provided.

Further characteristics and advantages of the invention will become apparent from the description which follows with reference to the appended drawings, provided purely by way of non-limiting example, in which.

Figures 3, 4:
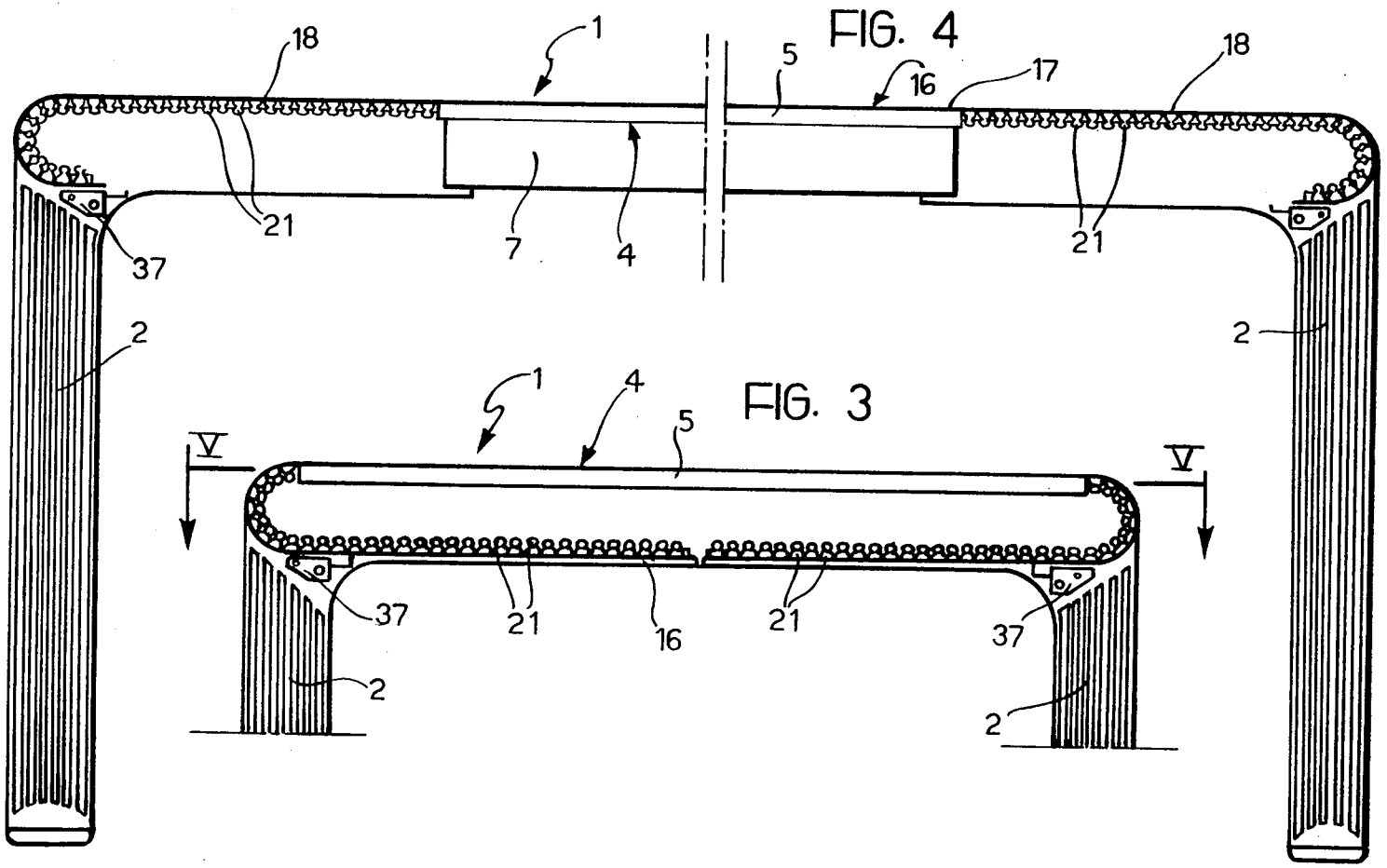
FIGS. 3, 4 are sections taken on the lines III—III and IV—IV respectively in FIGS. 1, 2.
Figure 5:
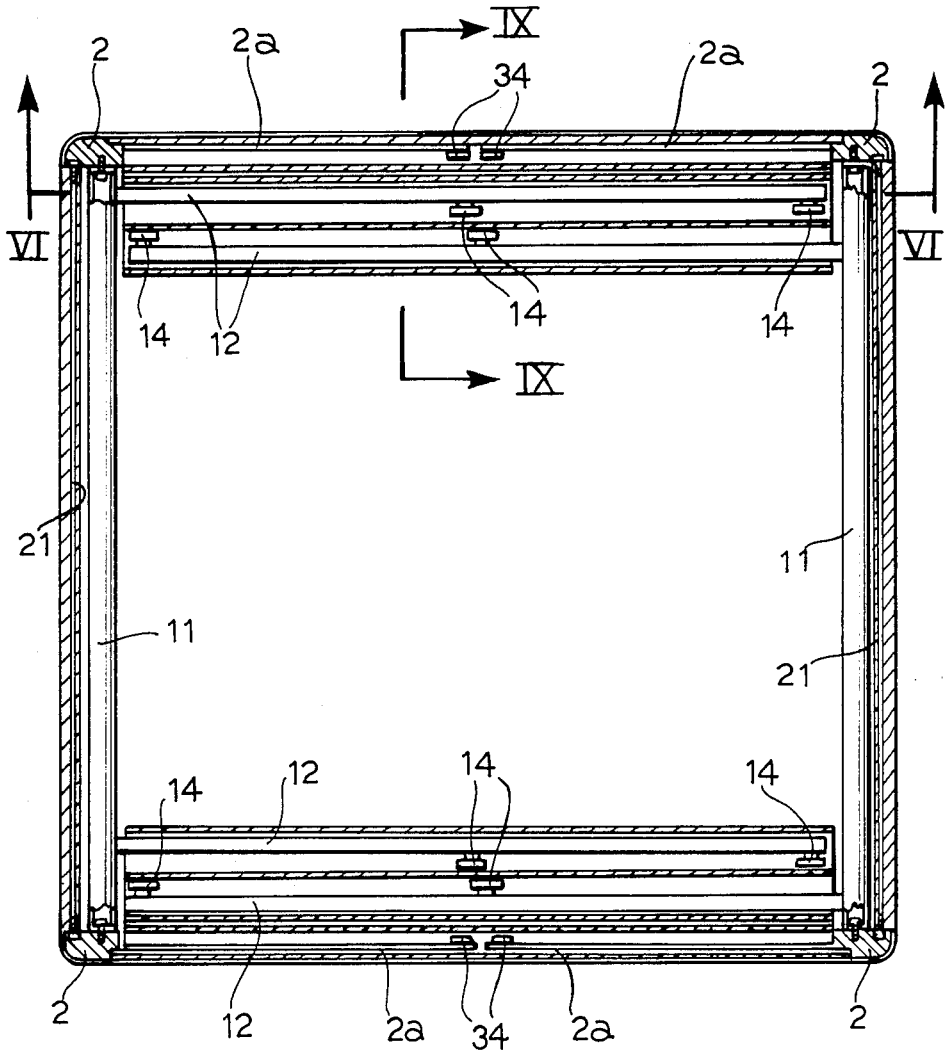
FIG. 5 is a section taken on the line V—V in FIG. 3.
Figure 6:
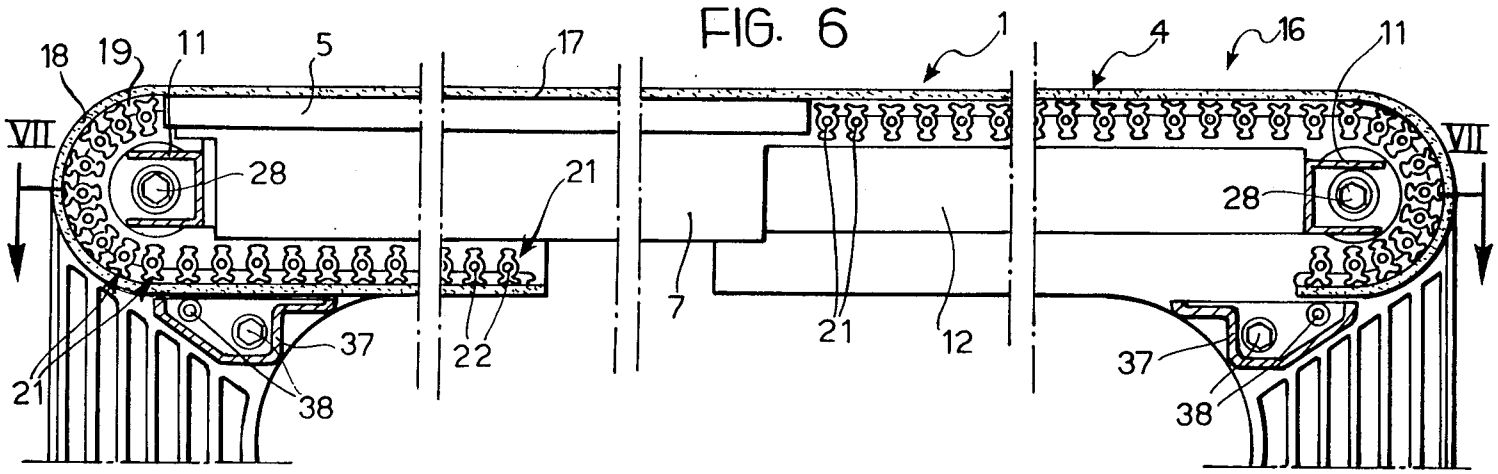
FIG. 6 is aa section taken on the line VI—VI in FIG. 1.
Figure 7:
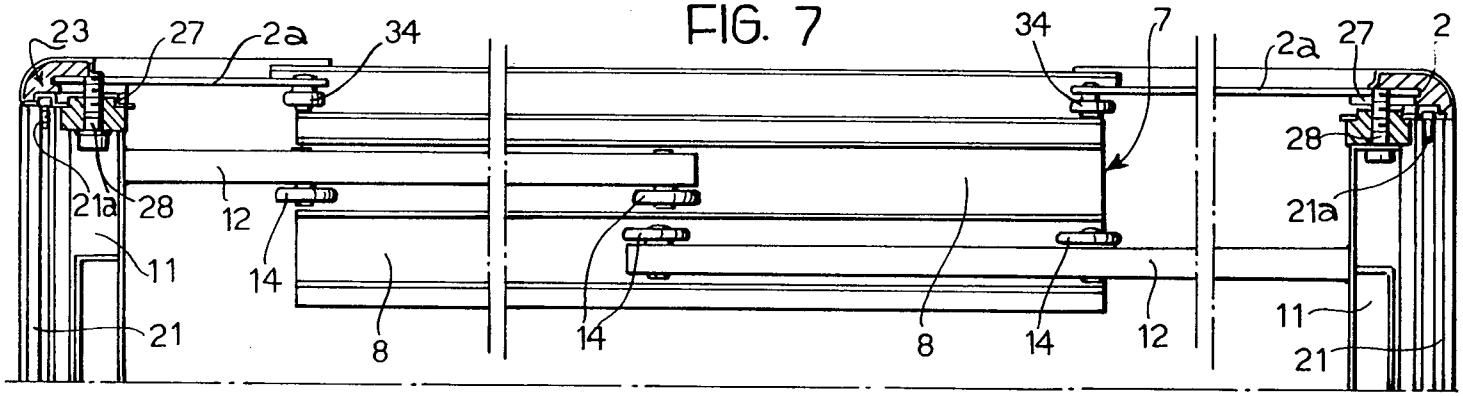
FIG. 7 is a partial section taken on the line VII—VII in FIG. 6.
Figure 8:
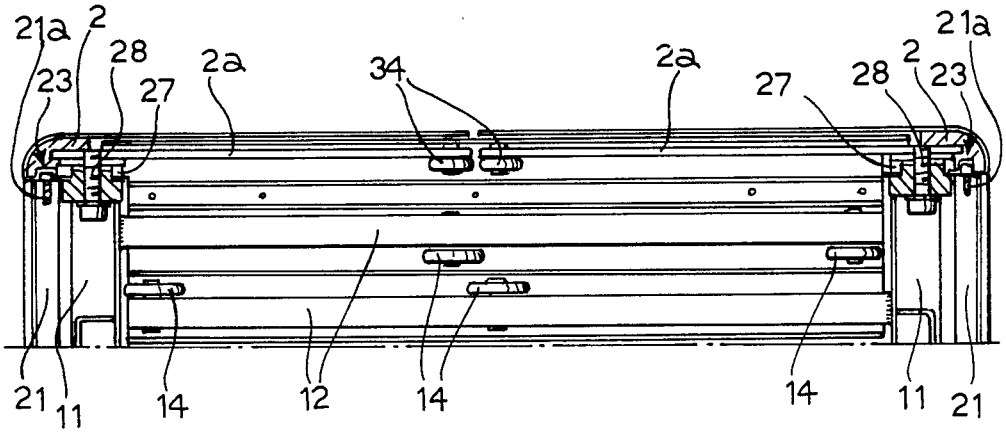
Figure 9:
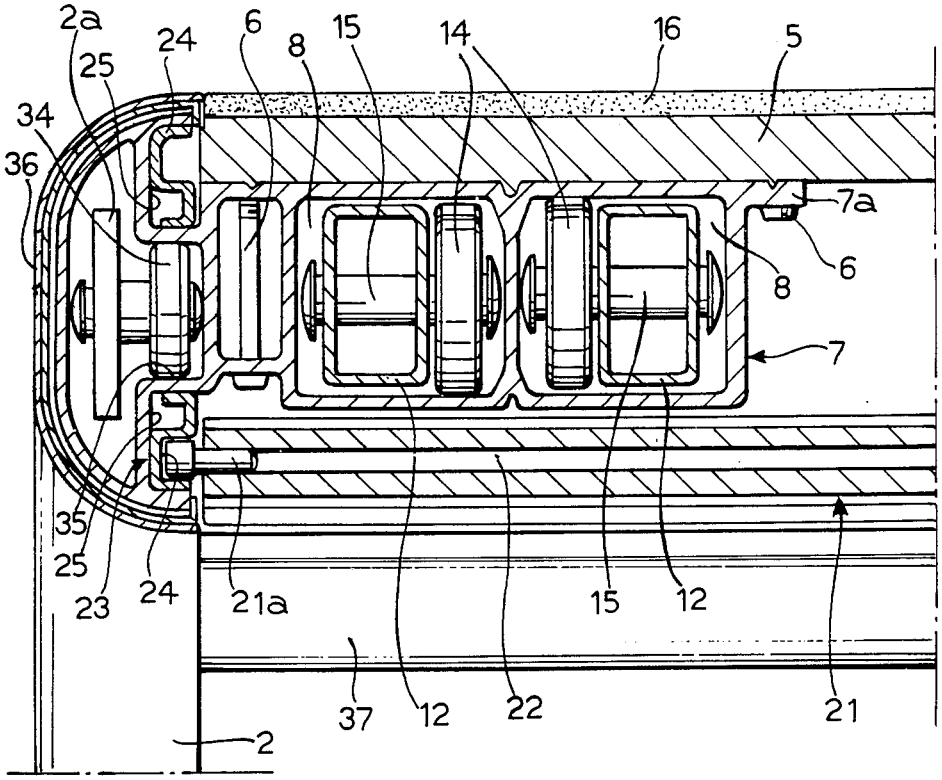
Figure 10:
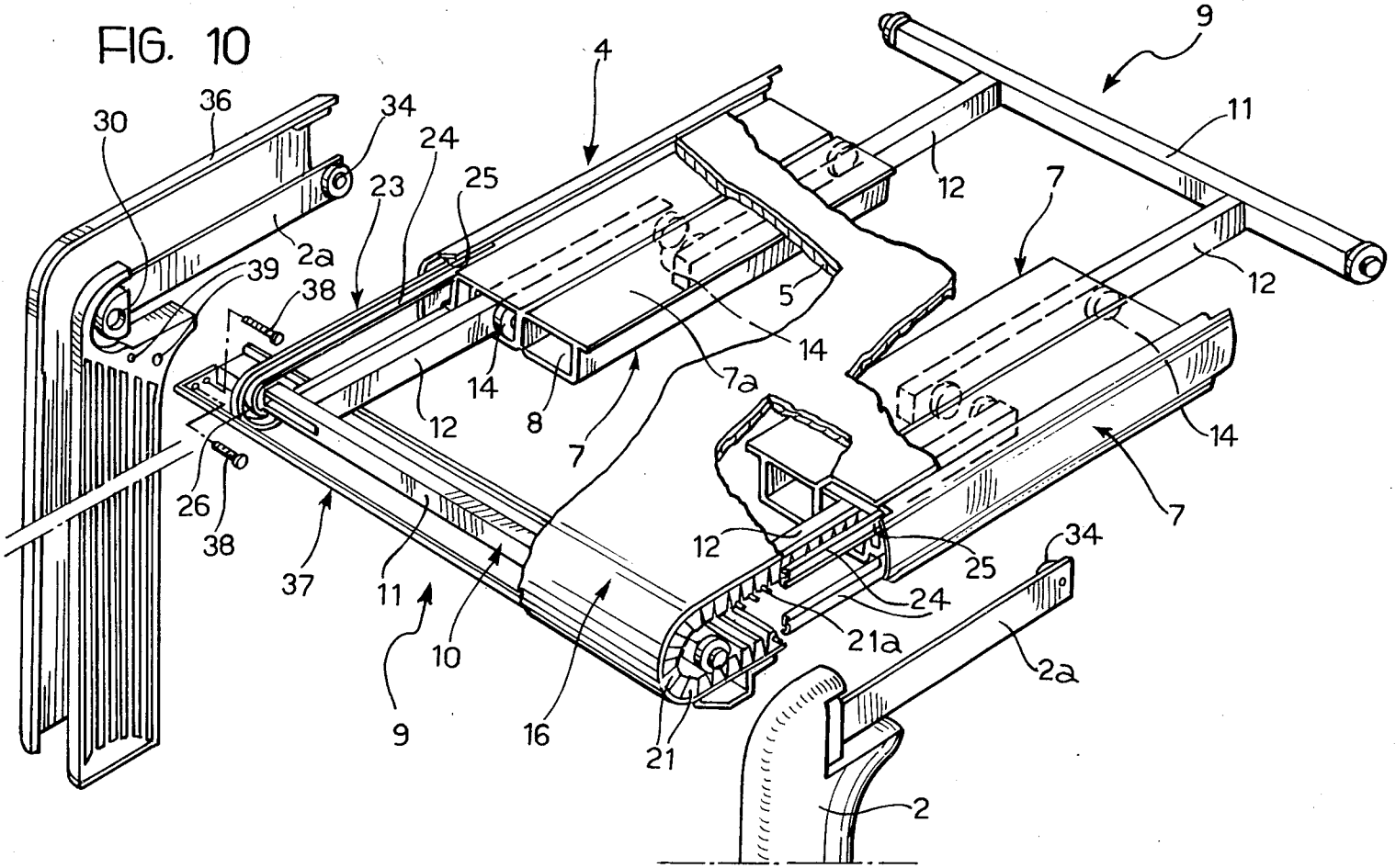
Figure 11:
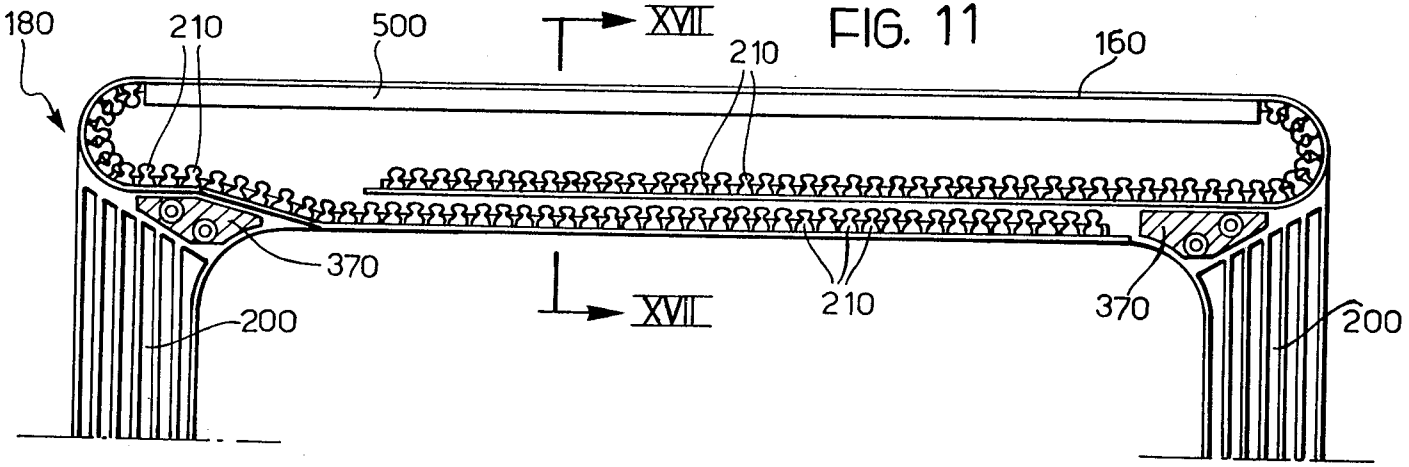
Figure 12:
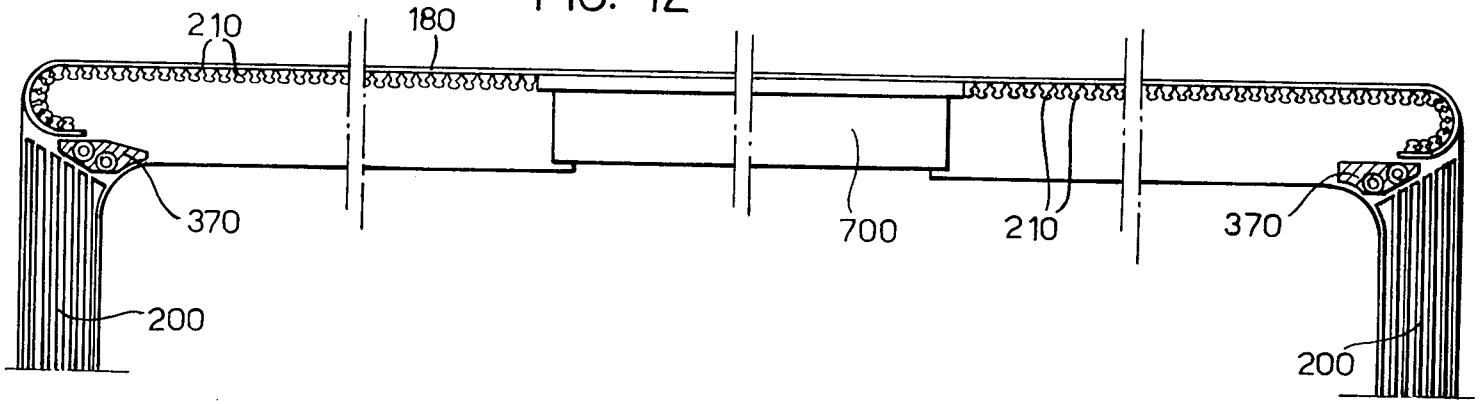
Figure 13:
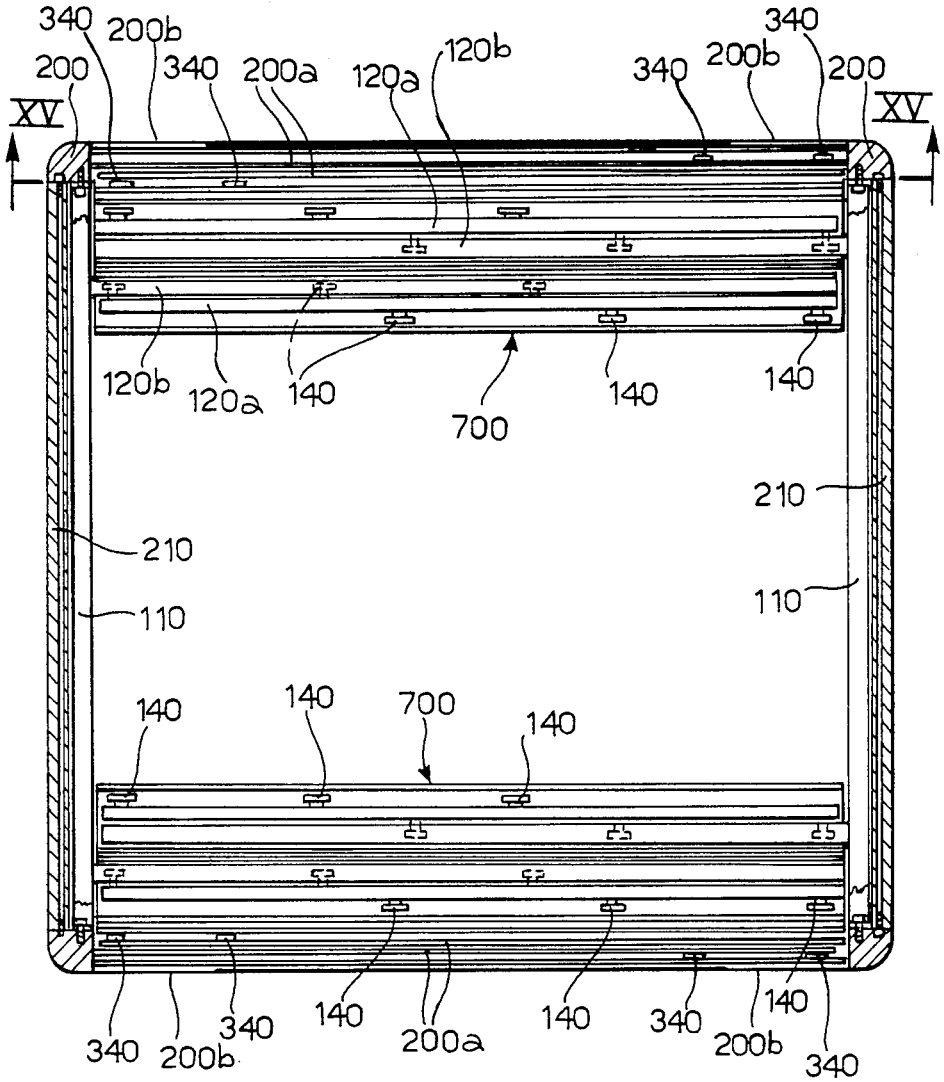
Figure 14:
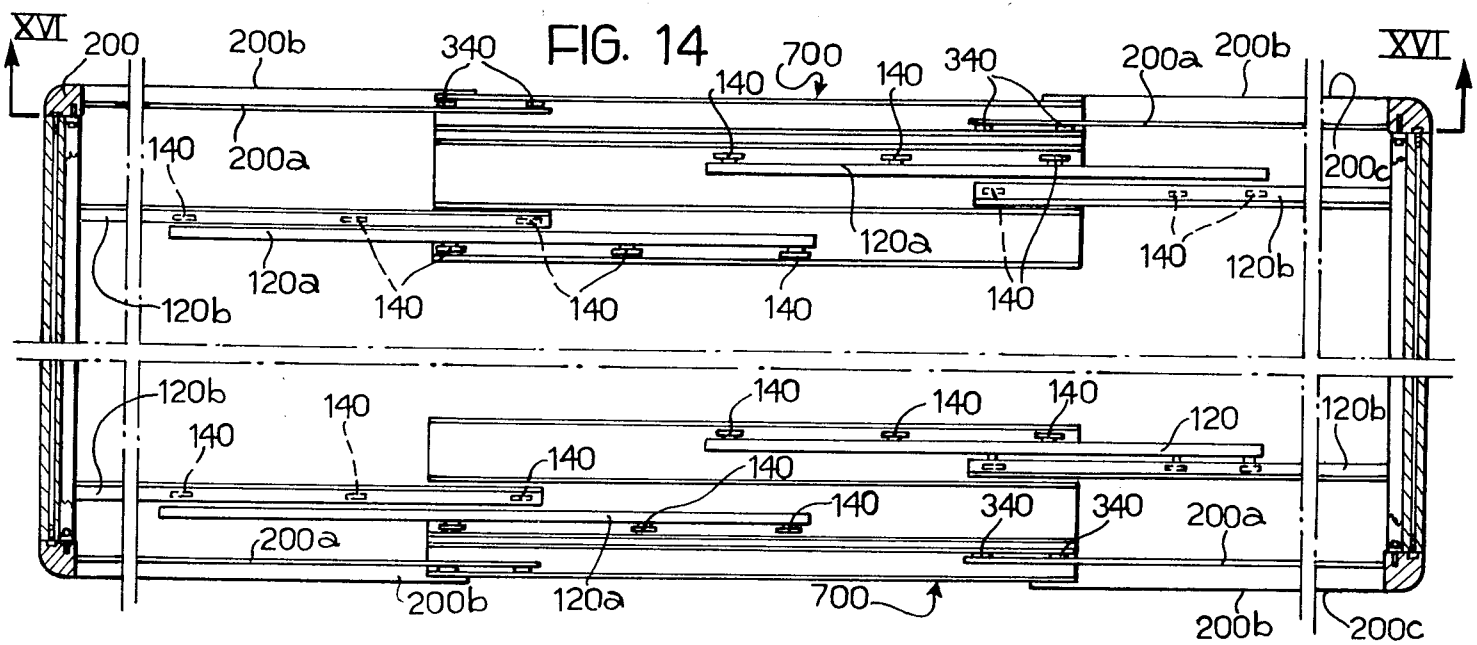
Figure 15:
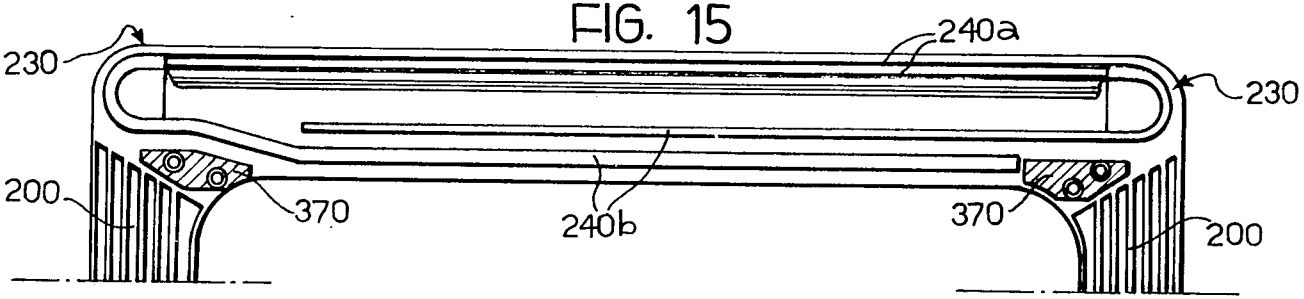
Figure 16:
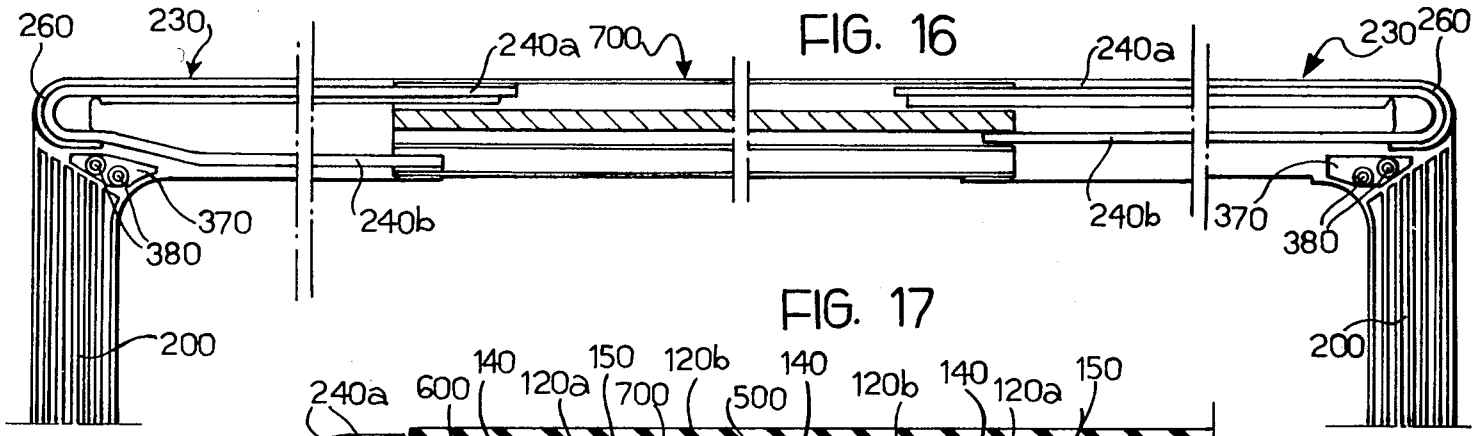
Figure 17:
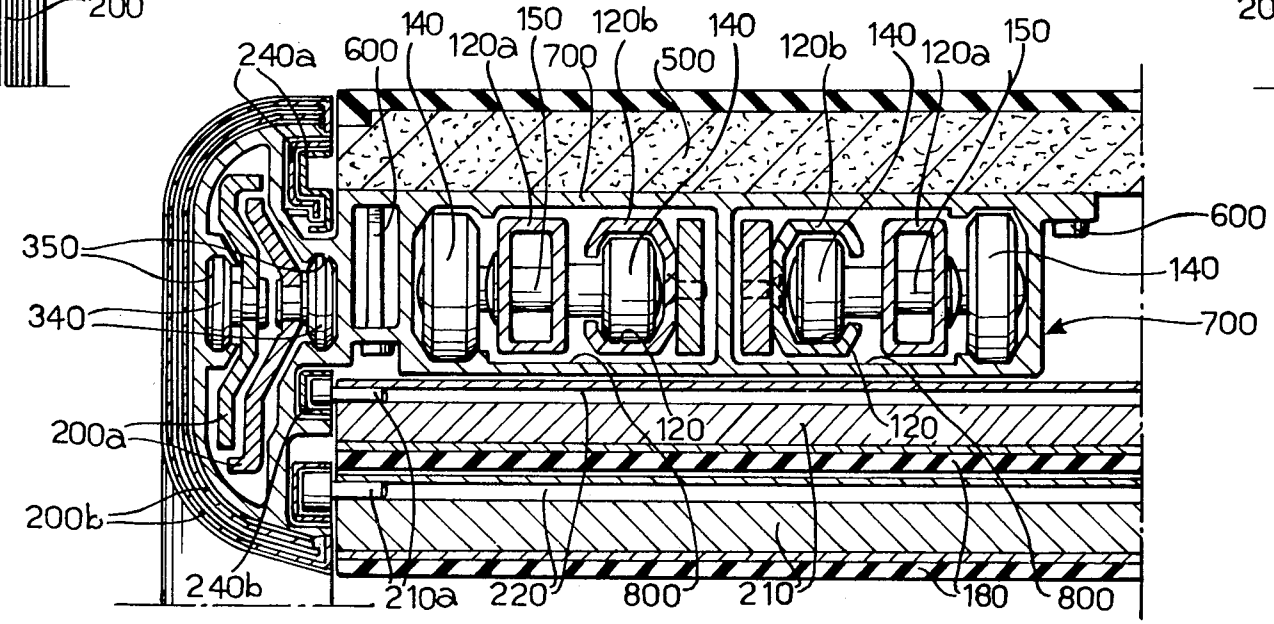
Figure 18:
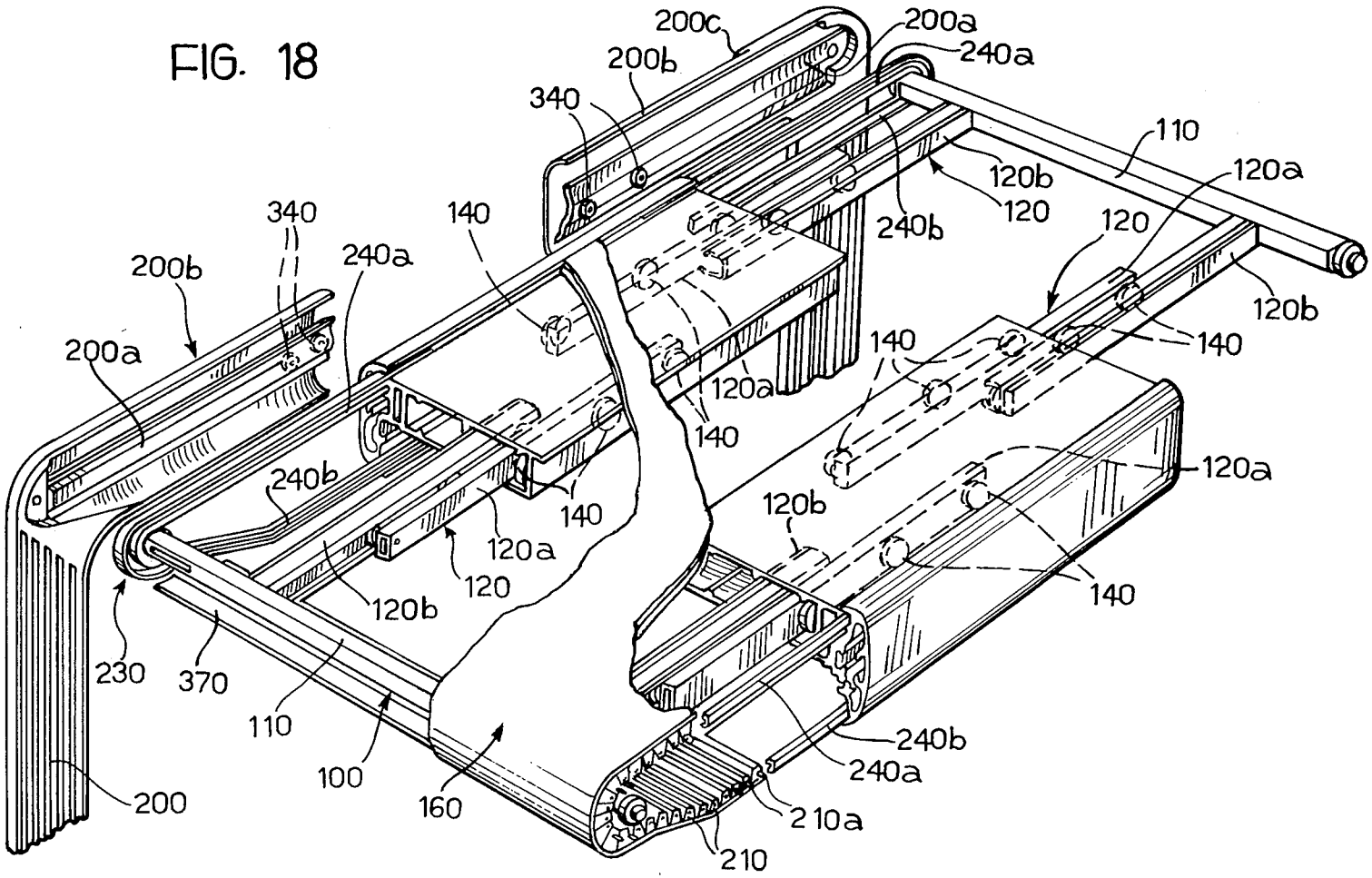

FIG. 8 is a view on an enlarged scale, in greater detail of a detail of FIG. 5, FIG. 9 is a section on an enlarged scale, taken on the line IX—IX in FIG. 5, FIG. 10 is an exploded, partially-sectioned perspective view of a part of the table of FIGS. 1 to 9, FIGS. 11 to 14 are variants of FIGS. 3, 4, 5, 7 which illustrate a second embodiment of the table of the invention, FIGS. 15, 16 are sections taken on the lines XV—XV and XVI—XVI in FIGS. 13, 14, FIG. 17 is a section taken on the line XVII—XVII in FIG. 11, on an enlarged scale, FIG. 18 is a view corresponding to FIG. 10 illustrating the table of FIGS. 11 to 17.

Figure 1:
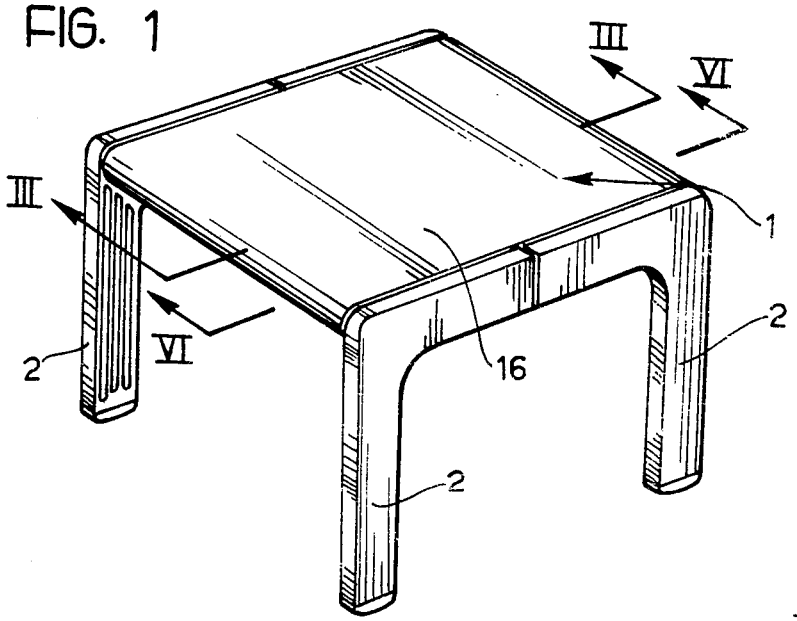
FIG. 1 is a schematic perspective view illustrating a first embodiment of the table according to the invention in the condition of minimum extension.
Figure 2:
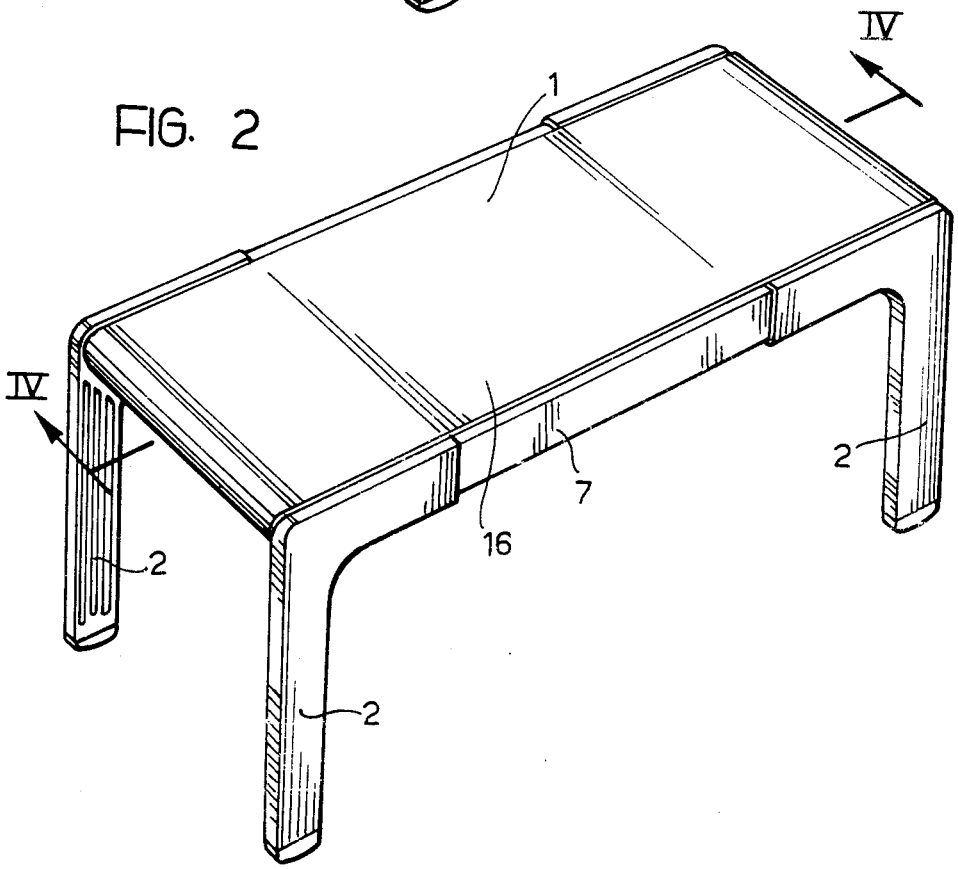
FIG. 2 is a perspective view illustrating the table of FIG. 1 in the condition of maximum extension.

FIGS. 1 and 2 illustrate one example of a table according to the invention, including a working plane generally indicated 1 and four support legs 2.

The table is capable of assuming any intermediate configuration between a condition of minimum extension (illustrated in FIG. 1) and a condition of maximum extension (illustrated in FIG. 2).

The working plane 1 is defined by a rigid panel 4 (see FIGS. 6, 10) including, in the example illustrated, a wooden panel 5 to the lower surface whereof are fixed by screws 6 two profiled elements 7, for example of extruded aluminium. The profiled elements 7 have two longitudinal guide passages 8 the function of which will be clarified below. Each profiled element 7 also has upper flanges 7*a* which are engaged by the fixing screws 6.

Reference numerals 9 indicate two structures for lengthening the rigid panel 4 including two frames 10 connected to the panel 4 so as to be slidable in a common direction parallel to the plane of the panel and intended to project from two opposite sides of the panel.

In the embodiment illustrated, each frame 10 has a cross member 11 arranged parallel to the plane of the panel and perpendicular to the direction of sliding of the frame and two guide rods 12 arranged parallel to the direction of sliding of the frame 10 and fixed to one end of the cross member 11, for example by welding. The guide rods 12 have a box structure and are slidably housed in two corresponding guide passages 8 of the profiled elements 7. As illustrated in detail in FIGS. 7, 9, 10 guide wheels 14 are mounted on each guide rod 12 and are constituted, for example, by rolling bearings covered with nylon, mounted on shafts 15 carried by the rods 12.

Reference numeral 16 indicates a flexible covering sheet constituted, for example, by plastics material such as polyurethane or polyvinyl chloride having a central part 17 (see FIG. 6) glued to the upper surface of the wooden panel 5 and two end parts 18 projecting from the opposite sides of the panel 4 from which the frames 10 also project. To the lower surface of the projecting parts of the flexible sheet 18 there is applied a layer of soft plastics material 19, for example polyvinyl chloride formed by extrusion, in which the stiffening bars 21 constituted by metal profiles, for example of aluminium, are partially embedded.

Each stiffening bar 21 has a longitudinal bore 22 in the ends of which nylon pins 21*a* (see FIG. 8) are inserted, having heads located outside the respective bores 22.

Two lateral U-profile guide channels 23 are fixed to the ends of the cross member 11 of each frame 10 (see FIGS. 9, 10) and each includes two horizontal parallel arms 24 slidable in two corresponding guide grooves 25 formed in the profiled elements 7. Each guide channel 23 further has a curved intermediate part 26 located concentrically with the axis of the cross member 11. Each guide channel 23 also has a wall 27 (see FIG. 7) at the centre of the curved intermediate part 26 which is fixed at the corresponding edge of the cross member 11 by a screw 28. The projecting heads of the pins 21*a* are slidable in the corresponding lateral guide channels 23.

With reference to FIGS. 3, 4, 6, 10, each projecting part 18 of the flexible sheet 16 engages the respective stiffening bars 21 in their respective guide channels 23, which act as guide means, so that the flexible sheet has an upper pass arranged as an extension of the part of the flexible sheet covering the rigid panel 4 and a lower pass guided parallel to and beneath the upper pass.

As is clear from FIGS. 3, 4 each of the two frames 10 is movable between a completely retracted position within the panel 4, in which the lengths of the upper and lower passes of the projecting part of the flexible sheet are respectively a minimum and a maximum and an extended condition in which the lengths of the upper and lower passes are respectively a maximum and a minimum. The table is adapted to assume any configuration between the extreme positions illustrated in FIGS. 3, 4. During extension or shortening of the table, the lateral guide channels 23 move together with the cross member 11, forcing the end pins 21*a* of the stiffening bars 21 to effect a relative movement within the channels until the frame 10 is in the desired position.

For any extended configuration of the frame, the portion of the flexible sheet 16 interposed between the rigid panel and the cross member 10 is stiffened by the bars 21.

A pair of table legs 2 is connected to each frame 10.

In the embodiment illustrated, each leg 2 is constituted by a cast aluminium body and is provided at its upper end with a horizontally elongate element 2*a* which projects from the upper end of the leg towards the central part of the table. Each element 2*a* has a hole 30 which is engaged by the screw 28 so as to be clamped to the corresponding end of the cross member 11 (see FIG. 7). The element 2*a* has a guide wheel 34 (see FIGS. 9, 10) engaged in a guide passage 35 in the profiled element 7. The outer surface of each leg body is also covered by a covering element 36, including for example an outer layer of wood and an inner layer of plastics material, which is slidable on the side of the corresponding profiled element 7.

Each pair of legs 2 is joined to a cross member 37 the ends of which are connected to respective legs by screws 38 which engage holes 39 (see FIG. 10) formed in the body of the leg and corresponding holes formed in the end of the cross member 37.

FIGS. 11 to 18 illustrated a second embodiment of the table of the present invention.

In the said drawings, parts corresponding to those indicated in FIGS. 1 to 10 are indicated by the same reference numerals with the addition of one or two zeros.

With reference to FIGS. 11, 12, the main difference with respect to the embodiments described previously lies in the fact that in the condition of maximum shortening of the table (see FIG. 11) the lower passes of the two end parts 180 of the flexible sheet 160 are disposed in different planes and are superimposed. The said disposition obviously allows the ratio between the maximum length and the minimum length of the table to be increased considerably.

As is clearly seen in FIGS. 15, 16, which illustrate the guide channels 230 in the condition of minimum and maximum extent of the table, the two lateral guide channels which are associated with the two frames 100 and which are disclosed on the same side of the table have their upper passes 240*a* arranged to slide one within the other in the condition of maximum shortening of the table (see FIGS. 15, 17), and their lower passes 240*b* disposed in two horizontal planes spaced from each other.

With reference to FIGS. 13, 14 and 18, in order to allow greater extension of the table, each guide rod 120 includes, in this case, a first portion 120*a* (see also FIG. 17) constituted by a box member carrying shafts 150 on which wheels 140 are rotatable and which engage the passage 800 of the profiled element 700, and a second portion 120*b* having a passage 120*c* (see FIG. 17) in which further wheels 140 carried by the shafts 150 are engaged. The second portion 120*b* is fixed to the cross member 110, as illustrated clearly in FIG. 18.

With reference to FIGS. 17, 18 each leg 200 of the table has an elongate element 200*a* at its upper end which extends horizontally and carries guide wheels 340 engaged in passages 350 formed in the profiled element 700. Each leg 200 has a further upper extension in the form of a horizontal portion 200*b* which covers the elongate element 200*a*.

As clearly illustrated in FIG. 14, the horizontal portion 200*b* of each pair of opposing legs 200 has a loop 200*c* whereby, in the condition of maximum shortening of the table the two portions 200*b* associated with the two opposing legs disposed on the same side of the table are superimposed on each other (see FIG. 17). The same is true for the two elongate elements 200*a*. The wheels 340 associated with these elements project from the opposite faces thereof and engage the corresponding passages 350 of the profiled element 700 (see FIG. 17).

Naturally, while the principle of the invention remains the same, constructional details and embodiments may be varied widely with respect to those described and illustrated, purely by way of example, without thereby departing from the scope of the present invention.

For example, the flexible covering sheet of the table according to the invention need not include a continuous web of the type described above but may for example be constituted by a structure similar to that of a venetian blind.

I claim:

1. An extensible table comprising in combination:

a rigid panel defining a working plane of the table in a condition of minimum extension thereof, and two structures for extending a rigid panel from two opposite sides thereof;

each structure comprising a frame connected to the panel for sliding movement in a direction parallel to the plane of the panel between an extreme retracted position within the panel and an extreme extended position in which said frame projects from one side of the panel;

a pair of table legs connected to each frame;

a flexible continuous covering sheet having a central part fixed to and covering the rigid panel and two end parts projecting from the panel and extending in the direction of sliding of each frame;

a plurality of stiffening bars connected to the lower surface of each end part of the flexible continuous covering sheet which projects from the rigid panel, said bars having pins projecting from opposite ends thereof with said bars being perpendicular to the direction of sliding of each frame;

said rigid panel being provided with guide passages and each frame including at least one pair of guide rods slidable in said guide passages and a cross member fixed to the ends of the guide rods farthest from the panel; and guide means for said stiffening bars carried by each frame and engaged by said pins, said guide means for each frame comprising two lateral U-shaped guide channels secured to said cross member and engaged by said pins with each guide channel having two parallel horizontal passes and a curved intermediate part whereby the flexible continuous sheet connected to the stiffening bars will have a first pass constituting an elongation of the working plane and a second pass guided beneath said first pass, whereby the lengths of the first and second passes are a minimum and a maximum, respectively, in the completely retracted position of the frame and a maximum and a minimum, respectively, in the completely extended position of the frame.

2. Table as defined in claim 1, wherein the panel is provided with guide grooves and each table leg has a horizontal elongate element at its upper end, said element being slidable on one side of the rigid panel and being provided with a guide member slidable in a corresponding said guide groove in the panel.

3. Table as defined in claim 1, wherein the rigid panel includes at least one extruded metal profile in which said guide passages are formed.

4. Table as defined in claim 3, wherein said rigid panel includes a wooden board to the lower surface of which said metal profile is fixed and wherein said flexible covering sheet is made of flexible plastics material.

5. Table as defined in claim 4, including a layer of soft plastics material applied to the lower surface of the part of the flexible sheet which projects from the rigid panel and wherein said stiffening bars are partially embedded in said plastics material.

6. Table as defined in claim 1, wherein said guide rods have rolling means which engage in said guide passages.

7. Table as defined in claim 1, wherein each stiffening bar has a longitudinal hole in the ends of which are inserted said pins which engage said lateral guide channels.

8. Table as defined in claim 1, wherein in the condition of minimum extension of the table, the lower passes of the two end parts of the flexible covering sheet are coplanar and have adjacent end edges facing each other.

9. Table as defined in claim 1, wherein in the condtion of minimum extension of the table, the lower passes of the two end parts of the flexible covering sheet are disposed in different superimposed planes.

10. Table as defined in claim 9, wherein the two lateral guide channels associated with the two frames for lengthening the table and disposed on the same side thereof have their upper passes arranged to engage slidably one within the other in the condition of minimum extension of the table and their lower passes disposed in two horizontal spaced apart planes.

11. Table as defined in claim 10, wherein each guide rod includes at least one first portion slidable relative to the panel and at least one second portion slidable relative to the first portion and fixed to the cross member.

12. Table as defined in claim 10, wherein the rigid panel is provided with guide grooves and each table leg has a horizontally-elongate element at its upper end, slidably mounted on one side of the panel and provided with guide members engaged in a corresponding said guide groove in the panel.

13. Table as defined in claim 12, wherein the body of each leg extends upwardly with a horizontal portion which covers said elongate member.

14. Table as defined in claim 13, wherein the upper horizontal portions and the elongate elements associated with the two sides of the table which can be moved away from each other, disposed on the same sides thereof, are superimposed on each other in the condition of minimum extension of the table.

* * * * *